US007167104B2

(12) United States Patent
DiPiazza

(10) Patent No.: US 7,167,104 B2
(45) Date of Patent: Jan. 23, 2007

(54) SYSTEM AND METHOD TO WIRELESSLY COMMUNICATE INFORMATION BETWEEN TRAFFIC CONTROL SIGNS AND VEHICLES

(75) Inventor: Gerald Charles DiPiazza, Edenton, NC (US)

(73) Assignee: M/A-Com, Inc., Lowell, MA (US)

( * ) Notice: Subject to any disclaimer, the term of this patent is extended or adjusted under 35 U.S.C. 154(b) by 203 days.

(21) Appl. No.: 10/869,411

(22) Filed: Jun. 16, 2004

(65) Prior Publication Data

US 2005/0280552 A1 Dec. 22, 2005

(51) Int. Cl.
*G08B 1/09* (2006.01)

(52) U.S. Cl. ..... 340/905; 340/539.1; 340/901; 340/933; 340/936; 701/117; 701/119

(58) Field of Classification Search ..... 340/905, 340/901, 539.1, 933, 936, 995.3, 995.7; 701/117
See application file for complete search history.

(56) References Cited

U.S. PATENT DOCUMENTS

| | | | | |
|---|---|---|---|---|
| 4,115,757 | A * | 9/1978 | Blahunka | 340/906 |
| 6,344,828 | B1 * | 2/2002 | Grantz et al. | 343/713 |
| 6,452,533 | B1 * | 9/2002 | Yamabuchi et al. | 342/70 |
| 6,606,033 | B1 * | 8/2003 | Crocker et al. | 340/901 |
| 6,707,391 | B1 * | 3/2004 | Monroe | 340/901 |
| 6,909,893 | B2 * | 6/2005 | Aoki et al. | 455/422.1 |
| 2003/0025286 | A1 * | 2/2003 | Meibock et al. | 280/11.19 |
| 2004/0242087 | A1 * | 12/2004 | Hoshina | 439/894 |

* cited by examiner

*Primary Examiner*—Jeffery Hofsass
*Assistant Examiner*—Hongmin Fan

(57) ABSTRACT

A system and method to wirelessly communicate information between traffic control signs and vehicles are provided. The method includes wirelessly communicating traffic control information from a traffic control sign to a vehicle and wirelessly communicating vehicle information from the vehicle to the traffic control sign.

28 Claims, 4 Drawing Sheets

SYSTEM AND METHOD TO WIRELESSLY COMMUNICATE INFORMATION BETWEEN TRAFFIC CONTROL SIGNS AND VEHICLES

BACKGROUND OF THE INVENTION

This invention relates generally to traffic control signs, and more particularly, to systems for wirelessly communicating information between traffic control signs and vehicles.

Drivers traversing roadways in their vehicles are provided with many different traffic control signs having traffic control information, such as, for example, sign-directed cautions, alerts and information. This traffic control information is typically provided along and above the roadway to control traffic, as well as display other useful information (e.g., next rest area). For example, permanent sign-related information may include information relating to speed limits, dangerous intersections, sharp turns, construction zones, railroad crossings, school zones, stop signs, detours, merges, etc. Additionally, and for example, temporary sign-related information may include manually-held signs alerting drivers of construction, lane changes, accidents, detours, etc. Further, sign-related information may be provided on vehicles, such as, for example, a stop sign on a school bus, a slow vehicle sign on slow moving vehicles and a wide load sign on larger vehicles. This sign-related information is intended to control traffic, prevent accidents and provide drivers with useful information.

The size, shape, color, and positioning of traffic control signs to provide sign-related information is typically selected to maximize visibility by drivers. However, external factors may affect the effectiveness of providing this information to drivers. For example, elderly drivers may not see or process the information on a traffic control sign as readily as younger drivers. Further, sleepiness and/or driver fatigue may result in a loss of attention to the information provided on traffic control signs. In other instances, environmental factors may affect the effectiveness of providing this information. For example, hilly terrain or outgrowth of plants and trees may obscure traffic control signs from a driver, thereby resulting in the information on the sign never being seen by a driver or seen too late. Weather conditions also may obscure traffic control signs and, for example, limit the distance from which a driver can view the information on a sign.

Thus, the effectiveness of traffic control signs to provide information to drivers is often reduced by factors or circumstances beyond the positioning or configuration of the signs, including driver incompetence, driver age, indifference or inattention, roadway limitations or impairments and/or weather conditions. Reduction or limitation of the ability to view these signs decreases the effectiveness of these signs and may increase the likelihood of accidents or other undesirable or unintended consequences.

BRIEF DESCRIPTION OF THE INVENTION

According to an exemplary embodiment, a method for communicating between vehicles and traffic control signs is provided. The method includes wirelessly communicating traffic control information from a traffic control sign to a vehicle and wirelessly communicating vehicle information from the vehicle to the traffic control sign.

According to another exemplary embodiment, a method for communicating information to a vehicle is provided. The method includes wirelessly transmitting traffic control information from a traffic control sign and wirelessly receiving in a vehicle, the traffic control information transmitted from the traffic control sign.

According to yet another exemplary embodiment, a communication system is provided that includes at least one traffic control sign configured to wirelessly transmit traffic control information and at least one vehicle receiver configured to receive the traffic control information transmitted from the at least one traffic control sign.

DETAILED DESCRIPTION OF THE INVENTION

Figure 1:
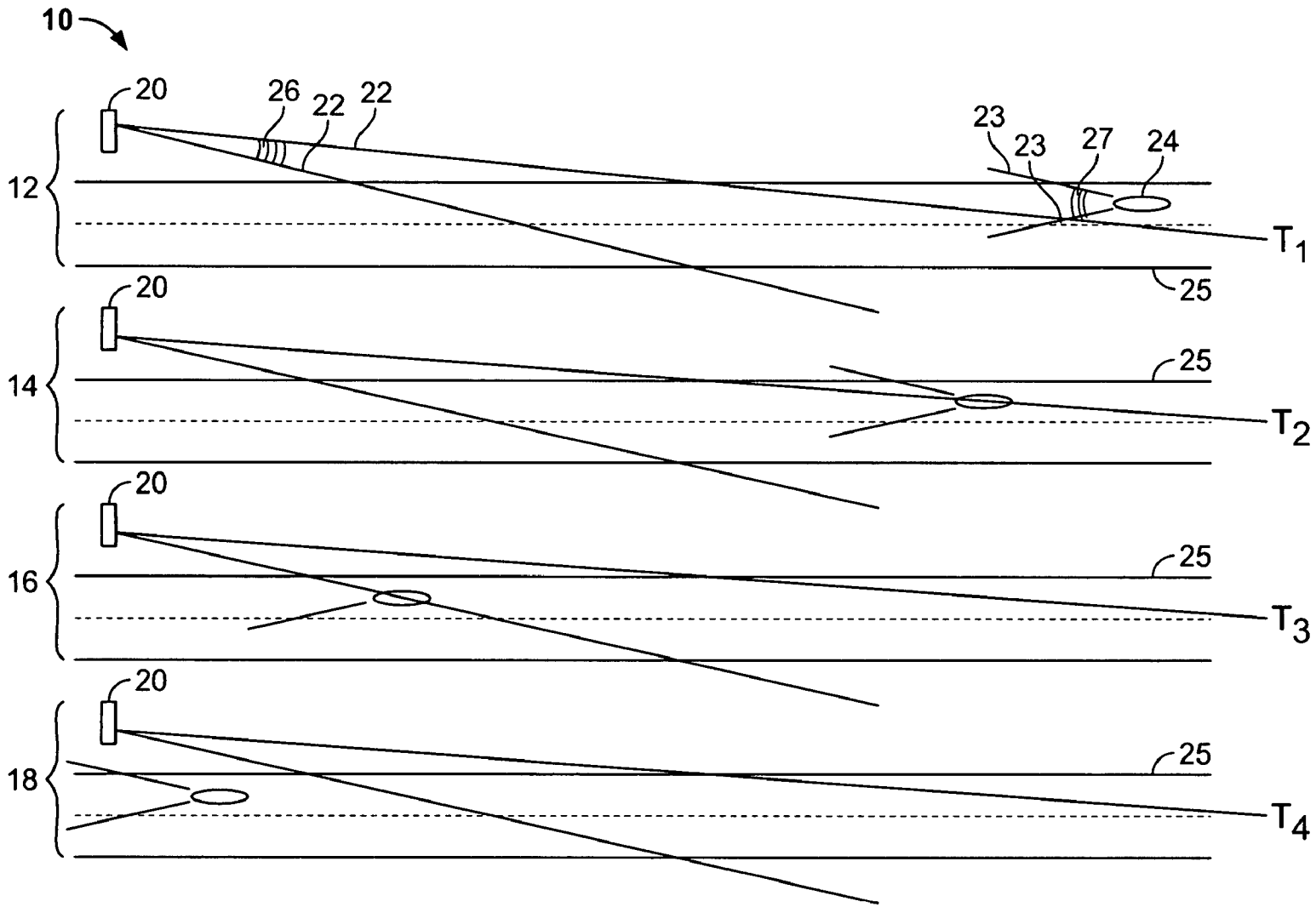
FIG. 1 is a diagram illustrating wireless transmission of information between a traffic control sign and a vehicle in accordance with an exemplary embodiment of the invention.

FIG. 1 illustrates an exemplary embodiment of a communication system 10 for wirelessly communicating traffic control and vehicle information. The communication system 10 generally includes one or more traffic control signs 20 configured to wirelessly transmit traffic control information 26 within at least one transmission beam 22. The transmission beam 22 may be focused to communicate with one vehicle 24 at a time using a millimeter-wave (MMW) transmission link as described in more detail below. For example, the traffic control sign 20 communicates with a single vehicle 24 travelling a roadway 25 in a certain area of the roadway 25. FIG. 1 shows the vehicle 24 travelling the roadway 25 from right to left at different points in time, $T_1$ through $T_4$. The vehicle 24 is shown at different points in time at different positions relative to the transmission beam 22.

It should be noted that as used herein, traffic control sign refers to any sign, indication or other alerting or notifying device along, beside, on, adjacent to and/or above a roadway 25 whether or not related to the operation of a vehicle 24. For example, the traffic control sign 20 may be a non-self-illuminating traffic control sign, a self illuminating traffic control sign, a traffic control light, a billboard, as well as any hazard zone artifacts, including flashing road barricades, lane divider cones, barrels, etc.

Specifically, at $T_1$ (identified by reference numeral 12) the vehicle 24 is outside of and approaching the transmission beam 22. The traffic control sign 20 is not communicating with the vehicle 24 via transmission beam 22 at time $T_1$. The vehicle 24 enters the transmission beam 22 at time $T_2$ (identified by reference numeral 14) and leaves the transmission beam 22 at time $T_3$ (identified by reference numeral 16). During the time interval between $T_2$ and $T_3$, the traffic control sign 20 may be communicating with the vehicle 24 via transmission beam 22 as described in more detail herein.

For example, the vehicle 24 may be receiving traffic control information 26 from the traffic control sign 20. At time $T_4$ (identified by reference numeral 18), the vehicle 24 is outside of the transmission beam 22 and no longer receiving information from the traffic control sign 20. Thus, at time $T_4$, the traffic control sign 20 is not communicating with the vehicle 24 via the transmission beam 22. However, it should be noted that in other embodiments as described herein, the traffic control sign 20 may communicate with the vehicle 24 after is passes the traffic control sign 20.

Figure 2:
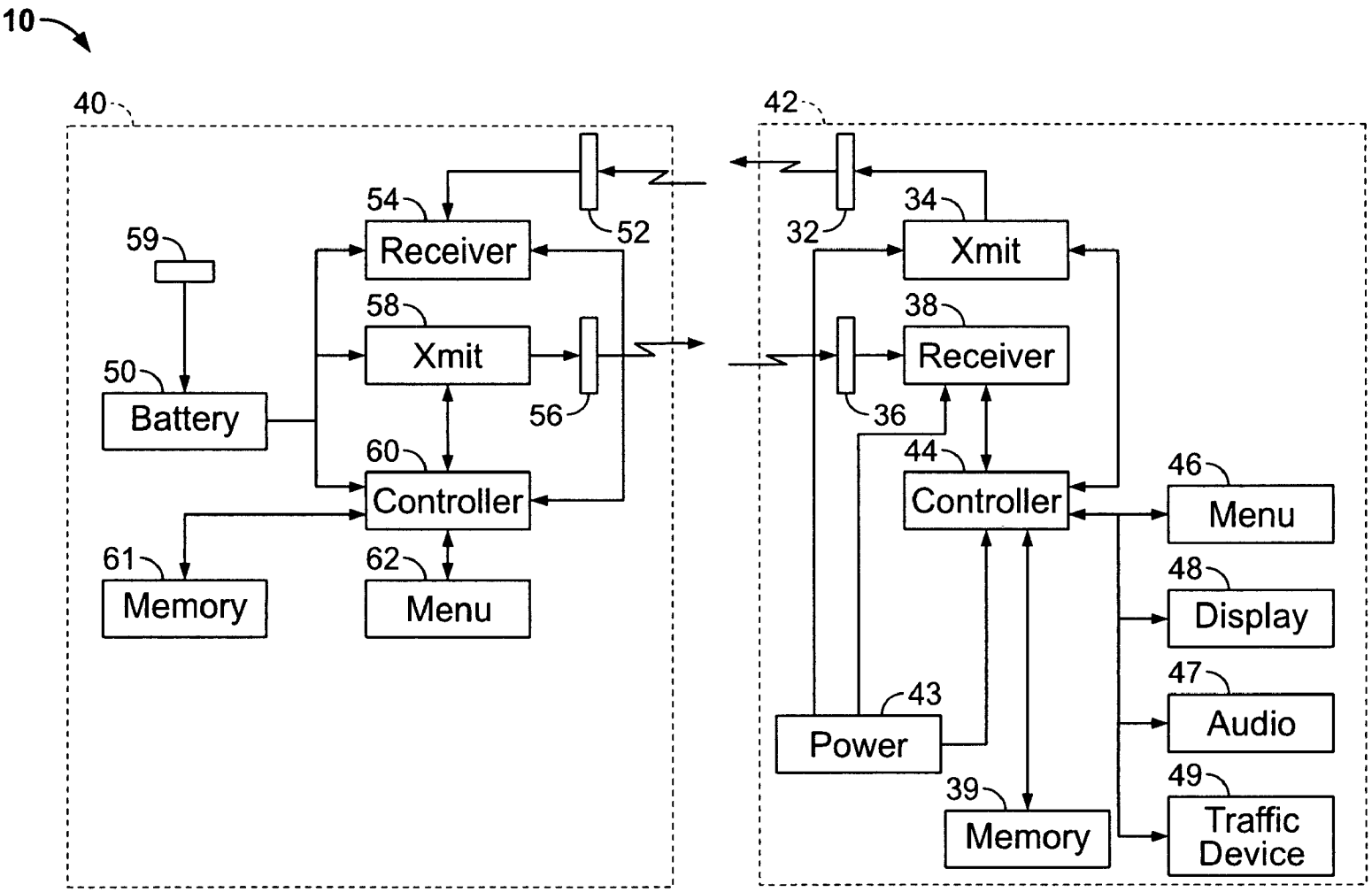
FIG. 2 is a block diagram of a system in accordance with an exemplary embodiment of the invention for wirelessly communicating information between a traffic control sign and a vehicle.

Further, it should be noted that more than one transmission beam may be transmitted by the traffic control sign 20 (e.g., transmitting multiple transmission beams 22) along the roadway 25 using a plurality of transmitters 58 (shown in FIG. 2). For example, the traffic control sign 20 may be transmitting to a vehicle 24 during a time interval when the vehicle is approaching the traffic control sign 20 (e.g., when the vehicle 24 is within transmission beam 22) with one transmitter 58, and with another transmitter 58 during another time interval when the vehicle 24 is leaving or passing the traffic control sign 20.

The various embodiments of the invention are not limited to unidirectional communication, but may provide bi-directional communication. For example, as also shown in FIG. 1, the vehicle 24 may transmit vehicle information 27 (e.g., speed information) within a transmission beam 23 to be received by a receiver 54 (shown in FIG. 2) of the traffic control sign 20. It should be noted that multiple transmission beams 23 may be transmitted by the vehicle 24, such as, for example, one transmission beam 23 from a front bumper 70 (shown in FIG. 3) of the vehicle 24 and one transmission beam 23 from a back bumper 72 (shown in FIG. 3) of the vehicle 24. The vehicle 24 may wirelessly transmit vehicle information 27 to the traffic control sign 20 during a time interval when approaching the traffic control sign 20 and during a time interval when leaving or passing the wireless traffic control sign 20, and which may be transmitted from different bumpers 70 or 72 of the vehicle 24. Further, it should be noted that wireless communication as used herein includes, but is not limited to, radio frequency (RF) communication.

FIG. 2 illustrates a detailed block diagram of the communication system 10 for wirelessly communicating information between a traffic control sign 20 and a vehicle 24. The communication system 10 generally includes a traffic control sign communication control component 40 and a vehicle communication control component 42. The traffic control sign communication control component 40 is connected to or integrated as part of the traffic control sign 20 and the vehicle communication control component 42 is connected to or integrated with the vehicle 24. In particular, the traffic control sign communication control component 40 includes a power source, such as, for example, solar cell(s) 59 and a battery 50, a receiving antenna 52 connected to a receiver 54, a transmitting antenna 56 connected to a transmitter 58, and optionally, a controller 60 having operations selectable, for example, using a menu 62, and a memory 61. It should be noted that the transmitting and receiving may be provided, for example, by a single combined transmit/receive antenna and a transceiver.

The vehicle communication control component 42 generally includes transmitting antenna 32 connected to a transmitter 34, a receiving antenna 36 connected to a receiver 38, a controller 44 having operations selectable using, for example, a menu 46, a display 48 (e.g., for displaying the menu), an audio output device 47, a tactile device 49, a memory 39, and a power source 43. It should be noted that the additional or different components may be provided to the traffic control sign communication control component 40 and vehicle communication control component 42. For example, multiple receivers 54 and transmitters 58, and corresponding receiving antennas 52 and transmitting antennas 56 may be provided. Further, and for example, multiple receivers 38 and transmitters 34, and corresponding multiple receiving antennas 36 and transmitting antennas 32 or a single combined transmit/receive antenna and a transceiver also may be provided. This allows for the communication of multiple transmission beams 22 and 23 between the traffic control sign 20 and the vehicle 24.

Additionally, the traffic control sign 20 may be directly powered by solar power using the solar cells 59 or the solar cells may charge the battery 50. Alternatively, operating power may be provided via replaceable batteries. In general, the transmitters as described in more detail herein may be powered, for example, by a power source of about ten milliwatts (mW) or less.

Further, power for components in the vehicle communication control component 42 may be provided, for example, from a power source 43 within the vehicle 24, such as the battery of the vehicle 24. Further, the traffic control sign 20 may be configured in a shape, size, and material composition such that the traffic control sign 20 operates as an antenna for transmitting traffic control information 26 and/or for receiving vehicle information 27. For example, the traffic control sign 20 may be provided as a flat metal plate configured as an antenna or a laminate structure having a patch antenna integrated therewith. Additionally, and for example, the traffic control sign may be constructed of a plastic material having a metal grid configured as an antenna integrated therewith or having metallic ink configured as an antenna provided therewith. Further, the traffic control sign may include a housing with the housing operating as an antenna (e.g., housing formed of a laminate structure having a patch antenna integrated therewith).

Further, the transmitters and receivers may be any suitable transmitting and receiving devices, for example, transmitters and receivers configured to operate based upon distance and application requirements.

Further, the controllers 40 and 60 may be any suitable processor, such as a central processing unit (CPU), computer processor with associated memory or a programmable calculating device configured to perform calculations. In general, the various embodiments of the present invention, including the controllers 40 and 60, may be implemented or embodied in the form of a computer or other processing system. Examples of a computer system include a general-purpose computer, a programmed microprocessor, a microcontroller, a peripheral integrated circuit element, and other devices or arrangements of devices that are capable of implementing the systems and methods of the various embodiments of the present invention and which may be provided as part of the traffic control sign 20 and vehicle 24.

For example, a processor (not shown) of the controller 60 executes a set of instructions that may be stored in one or more storage elements, for example, the memory 61, in order to process information, such as, for example, traffic control information 26 to be transmitted and/or received vehicle information 27. The storage elements also may store data or other information as desired or needed (e.g., speed limit information posted on the corresponding traffic control sign 20 or predetermined responses information). The storage elements may be in the form of an information source or a physical memory element within the processor.

The set of instructions may include various commands that instruct the processor to perform specific tasks to implement the systems and/or steps of the methods of various embodiments of the present invention as will be described herein. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data (e.g., vehicle information 27) by the processor may be in response to user commands, or in response to results of previous processing, or in response to a request made by another processor, such as for example, from another traffic control sign 20 or from a vehicle 24.

The communication system 10 may be a unidirectional or bi-directional communication system, wherein communicating wirelessly is performed on at least one of a plurality of frequencies within a predetermined frequency range. For example, a directive, low noise millimeter-wave (MMW) transmission link between the traffic control sign 20 and the vehicle 24 may be provided to allow unidirectional or bi-directional communication. Thus, a communication link between the traffic control sign 20 and vehicle 24 may be provided. In one embodiment, the MMW transmission is configured for transmission and reception in the twenty-four gigahertz (GHz) range with the antennas 32, 36, 52 and 56 configured as high-gain, flat-patch, array antennas. Transmit power may be modified as desired or needed, and in one embodiment, is approximately one mW to provide a transmission range of between about thirty feet and about 200 feet. The transmit power may be increased, for example, to five mW or more, if additional transmission distance is needed or desired, for example, in areas having long hilly terrain. This MMW transmission link provides a selective and focused communication link (e.g., transmission beam) between the traffic control sign 20 and vehicle 24. For example, and in one exemplary embodiment, a narrow beam providing directivity of between about five degrees and about twenty degrees in both the side to side and up and down directions is provided.

In one embodiment, the communication link operates at twenty-four GHz using directional antennas with the link operating at a range of about one-hundred feet between the traffic control sign 20 and the vehicle 24. In this embodiment, the communication link communicates one of a plurality of possible messages, for example one of 254 possible messages or a flag that a text message follows. The data format may be, for example, the first five bits of dotting then an eleven bit barker sequence followed by an eight bit message. To reduce the probability that a wrong message is received, the message may be transmitted a plurality of time, for example, three times, which then transmits a total of forty bits. At a ten kilobits per second (kbps) rate, message transmission occurs in about four milliseconds (ms). In one embodiment, the messages are transmitted every one-hundred milliseconds (ms). The periodicity of transmission may be adjusted, for example, based on power consumption requirements or speeds of vehicles.

If a text message is to be transmitted, an eleven bit barker sequence followed by an indication, for example, "message 0," is provided and that indicates a text transmission is to follow. In one embodiment, the text is transmitted as a six bit encoded stream with Reed Solomon error correction with the message ending with an inverted eleven bit barker sequence.

Although the data in this embodiment is transmitted using a twenty-four GHz carrier to provide a selective and focused communication link, other frequencies may be implemented. For example, a 5.8 GHz or 2.4 GHz system may be provided to provide, for example, broadcasting of signals between a plurality of traffic control signs 20 or to a plurality of vehicles 24.

In one embodiment, the carrier is AM modulated with a sub-carrier being 2 level FSK modulated. The transmitters 34 and 58 may be configured as desired or needed. In one embodiment, the transmitters 34 and 58 includes a twenty-four GHz oscillator (not shown) configured to operate in the 24 to 24.250 GHz ISM band. A dielectric resonator or a cavity to stabilize the oscillations may be provided. The oscillator also may be buffered with one stage of gain. The buffer then communicates with a matched single pole single throw (SPST) switch to provide ASK modulation to the transmitted signal.

In one embodiment, the antennas 32 and 56 are twenty decibel (dB) gain antennas and have a dimension of about six inches by about four inches. This results in transmission beam width coverage of about one lane of a roadway 25. The configuration of the antennas 32 and 56 may be modified to cover a wider or narrower area, for example, two lanes of a roadway 25. Further, and for example, the configuration of the antenna 32 may be modified to have dimensions allowing for mounting behind the grill or bumper cowling of the vehicle 24. Further, the dimensions of the antenna 32 may be modified based on, for example, transmission and reception requirements.

A 450 kHz oscillator creates the sub-carrier to drive the ASK modulator. The 450 kHz oscillator is FSK modulated by a data signal from a micro-controller (not shown), which may form part of or be configured as the controllers 44 and 60. In one embodiment, the data signal is Manchester encoded (XORed with the bit clock). The transmitters 34 and 58 are controlled by the controllers 44 and 60, which in one embodiment are low power microcontrollers. The controllers 44 and 60 control turning on and off the transmitters 34 and 58, as well as creating a transmit data stream (e.g., transmission beam 22 with traffic control information 26). The controllers 44 and 60 may be programmed to set the transmitted message with an external communications link with the message then stored in a non-volatile memory (not shown).

The receivers 38 and 54 are connected to antennas 36 and 52 similar to the antennas 32 and 56. The antenna 36 may be dimensioned for mounting behind the grill or bumper cowling of the vehicle 24. The antenna may be connected to a band pass filter (not shown) that performs pre-selection to remove specific band signals from the receivers 38 and 54. A low-noise amplifier (LNA) then may be provided giving a twenty dB gain. The LNA communicates the received signal to a detector diode (not shown). The detector diode demodulates the ASK modulation on the signal. The AM demodulated signal is then sent to a standard FM radio IF chain. The signal is then filtered by a 450 kHz band pass filter. The signal may be further amplified and filtered before being FM discriminated by a discriminator (not shown). The output from the discriminator is the original, Manchester encoded base band signal. Analog circuitry or a digital signal processor then processes the signal to provide the transmitted bits.

It should be noted that the various embodiments are not limited to a particular modulation or coding scheme or method. For example, different types of modulation or coding schemes or methods may be implemented, including, but not limited to, phase-shift keying (PSK), quadrature phase-shift keying (QPSK), complex modulation, etc.

Figure 3:
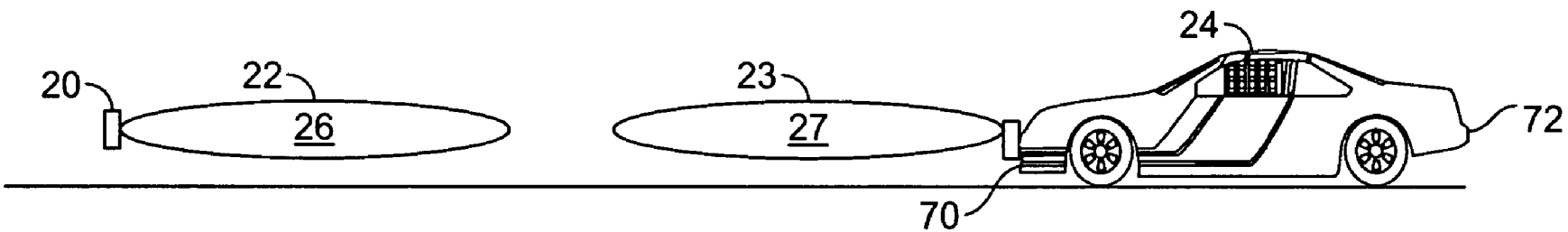
FIG. 3 is a diagram illustrating a configuration for communicating information between a traffic control sign and a vehicle in accordance with an exemplary embodiment of the invention.

Thus, in operation, and as shown in FIG. 3, a traffic control sign 20 may transmit traffic control information 26 to a vehicle 24, and the vehicle 24 may transmit vehicle information 27 to traffic control sign 20. The vehicle information 27 may include, for example, vehicle identification information (e.g., VIN number or license plate), vehicle speed and/or vehicle direction. The traffic control information 26 may include, for example, speed limit information, hazard information, warning information, alerting information, upcoming attraction information, etc. The information may be transmitted as messages for providing to a driver, and may include, for example, messages of excessive speed warning, sharp turn, dangerous intersection, road construction ahead, stopped traffic ahead, road hazard conditions, collision imminent, restaurants available at next exit, rest area at next exit, etc. It should be noted that in response to receiving vehicle information 27 from the vehicle 24, the traffic control sign 20 may transmit response information in addition to or as part of the traffic control information 26 as described herein. For example, in response to receiving speed information from a vehicle 24 indicating a speed in excess of a posted limited, the traffic control sign 20 may transmit an excessive speed warning as described herein.

Traffic control information 26 may be provided to the driver within the vehicle 24, for example, by visual means, audio means, or tactile means. As illustrated in FIG. 2, the controller 44, which may be a separate on-vehicle controller or may be integrated within an existing system (e.g., audio/video system or navigation system), may provide the traffic control information 26 and/or response information received from receiver 38 via the receive antenna 36 to the driver of vehicle 24, for example, via the display 48. Within the display 48, which may be a separate display within the vehicle 24 or part of, for example, an in-vehicle computer display, the driver may view messages (e.g., exceeding posted speed or upcoming work zone or sharp corner) as a result of the vehicle 24 receiving traffic control information 26 and/or response information from the traffic control sign 20. Alternatively, or in addition to the visual means, traffic control information 26 may be provided to the driver as an audio output from the audio output device 47. The driver of the vehicle 24 then hears messages (e.g., slow speed or school zone ahead) as a result of the vehicle 24 receiving the traffic control information 26 and/or response information. The messages may be provided via existing vehicle speakers or may be output from a separate audio output system that may be provided, for example, as an installable kit for a vehicle 24. Alternatively, or in addition to the visual and audible means, the tactile device 49 may operate, for example, to vibrate a seat (not shown) in the vehicle 24 in response to receiving the traffic control information 26 and/or response information to warn a driver of an upcoming condition (e.g., dangerous curve, possible icy bridge or car stopped and possible collision).

In operation, traffic control information 26 (including response information) may be transmitted to and received by the vehicle 24 in response to the vehicle 24 transmitting vehicle information 27 to traffic control sign 20. For example, the controller 44 may continuously or periodically acquire speed and direction information for the vehicle 24 from computers and other systems within the vehicle 24 (e.g., from a navigation system or speedometer). The controller 44 then may control the transmitter 34, and in particular, cause the transmitter 34 to transmit to the traffic control sign 20 via the transmitting antenna 32 certain vehicle information 27, such as, for example, vehicle speed, direction and identification information. This information may be transmitted continuously, periodically, or at specified predetermined points in time (e.g., when speed exceeds a predetermined limit, time of day or external temperature). In response, the traffic control sign 20, which receives and processes this information with controller 60, may transmit traffic control information 26 and/or response information to the vehicle 24 that may include messages regarding excessive speed, excessive speed for upcoming road conditions, stopped vehicle in the road, hazard condition in the road, direction of oncoming traffic, etc. The traffic control information 26 also may provide non-vehicle operating information, such as upcoming restaurants or rest stops, which information may be received, for example, from an in-vehicle navigation system and correlated to information being received from traffic control signs 20, which may be, for example, information from highway mile markers.

It should be noted that the vehicle information 27 may be used not only for alerting of upcoming conditions or of current conditions, but for locating a vehicle, such as, for example, a stolen vehicle or a vehicle used in a kidnapping. For example, the vehicle information 27 may include a complete description of the vehicle, including color, make, model, license plates, and VIN.

Further, and for example, the vehicle information 27 may be used to measure the speed and direction of the vehicle 24 instead of receiving this information from in-vehicle systems. Specifically, the time at the traffic control sign 20 when the vehicle 24 is communicating with that traffic control sign 20 can be recorded and stored, for example, in the memory 61. Thereafter, the time also can be recorded when the same vehicle 24, which may be identified, for example, by the transmitted VIN, is communicating with another traffic control sign 20, which also is communicating with the first traffic control sign 20. Using a known distance between the two traffic control signs 20 and using the distance between two transmission beam points on the roadway 25, the average speed between the two points for the vehicle 24 may be calculated, and may be used to approximate the instantaneous speed of the vehicle. Thus, in operation a radar speed determination may be provided by emitting a pulse from the traffic control sign 20 and timing the return of the pulse from a vehicle 24. In another exemplary embodiment, a Doppler speed determination may be provided by determining a shift in frequency of the return pulse. Speed tracking capabilities are thereby provided. The direction of the vehicle 24 also may be determined based on the transmission beam points on the roadway 25 and using different transmitters and receivers as described herein.

The various embodiments of the communication system 10, and in particular, the controllers 44 and 60, are configured to provide communication between at least one traffic control sign 20 and at least one vehicle 24. More particularly, the traffic control sign communication control component 40 and the vehicle communication control component 42 are configured to provide communication between the traffic control sign 20 having the traffic control sign communication control component 40 and the vehicle 24 having the vehicle communication control component 42. Specifically, and in an exemplary embodiment, the traffic control sign communication control component 40 and the vehicle communication control component 42 are configured to provide communication as illustrated in the flowchart in FIG. 4.

Figure 4:
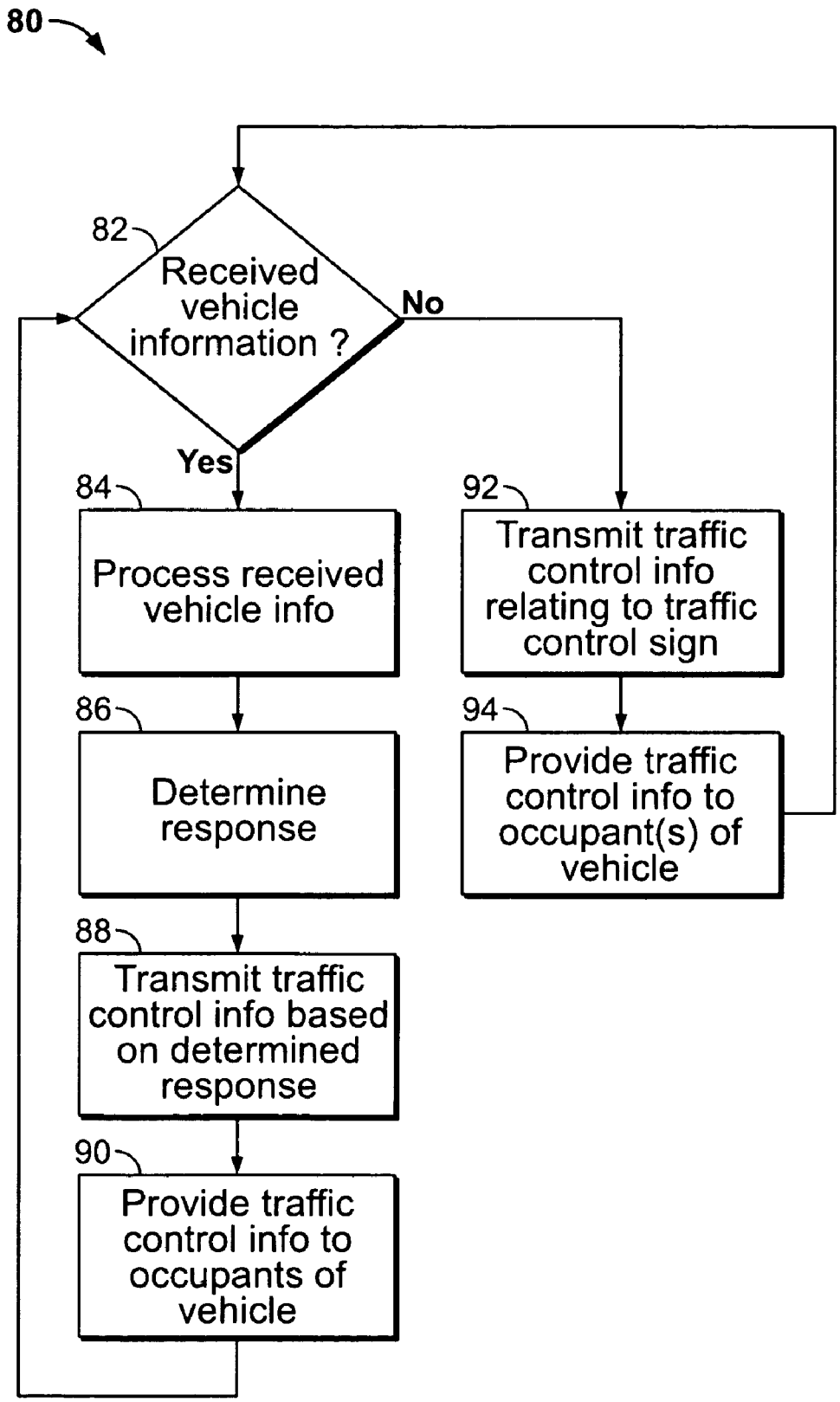
FIG. 4 is a flowchart illustrating a method for communicating information between a traffic control sign and a vehicle in accordance with an exemplary embodiment of the invention.

As shown in FIG. 4, and with reference to the communication system 10 shown in FIGS. 1 and 2, a communication process 80 provides communication of traffic control information 26 from traffic control sign 20 to the vehicle 24 and communication of vehicle information 27 and/or response information from the vehicle 24 to the traffic control sign 20. Specifically, at 82 a determination is made as to whether any vehicle information 27 has been received from the transmitter 34 of the vehicle communication control component 42 by the receiver 54 of the traffic control sign communication control component 40. For example, a determination is made as to whether any vehicle speed or direction information has been received via a transmission beam 23 from a vehicle 24 within the reception range of the traffic control sign 20 having the receiver 54. It should be noted that the vehicle information 27 may be received from more than one vehicle 24 within the reception range of the traffic control sign 20. If vehicle information 27 is received from more than one vehicle 24, the vehicle information 27 may be stored within the memory 61 of the traffic control sign communication control component 40.

If vehicle information 27 is received from a vehicle 24, then at 84, the received vehicle information 27 is processed as described herein. This may include determining whether more than one vehicle 24 is within the reception range of the traffic control sign 20. Specifically, and as described herein, at 86 a determination is made as to response information to transmit to the vehicle 24 in response to the received vehicle information 27. In one embodiment, a predetermined set of responses may be stored in the memory 61 and accessed to determine a response based on the received vehicle information 27. For example, if a determination is made at 86, based on the processed vehicle information 27, that the speed of the vehicle 24 has exceeded a posted speed limit (e.g., speed limit posted on the traffic control sign 20) as stored within the memory 61, the transmitter 58 of the traffic control sign communication control component 40 transmits a response. The response may include, for example, an "exceeded posted speed limit" or "slow vehicle speed" alert or notification. This response information is transmitted at 88 from the transmitter 58 of the traffic control sign communication control component 40 as part of the traffic control information 26 transmitted in the transmission beam 22. In another embodiment, the response information is transmitted separate from the traffic control information 26.

The response information, which may be transmitted as part of or separate from the traffic control information 26 is then received by the receiver 38 of the vehicle communication control component 42. The received response information is then provided at 90 to occupant(s) of the vehicle 24 having the vehicle communication control component 42. For example, the "exceeded posted speed limit" or "slow vehicle speed" response may be displayed or output audibly as described herein. Additionally, a tactile response may be provided.

If no vehicle information 27 is received at 82 (e.g., vehicles within range of a traffic control sign 20 are not transmitting information), then at 92 traffic control information relating to the traffic control sign 20 is transmitted to the vehicle using the transmitter 58. This traffic control information 26 may include, for example the posted speed limit, an upcoming reduced speed zone, a sharp turn, etc. In general, the traffic control information 26 includes any information related to the traffic control sign 20 having the traffic control sign communication control component 40. This may include, information unrelated to the operation of a vehicle 24, such as, for example, information relating to upcoming rest stops, gas stations, restaurants, etc. as displayed on the traffic control sign 20. The received traffic control information 26 is then provided at 94 to occupant(s) of the vehicle 24 having the vehicle communication control component 42 and as described in more detail herein.

It should be noted that in other embodiments, the traffic control information 26 and/or vehicle information 27 may be transmitted continuously or periodically and not in response to received information. Therefore, traffic control information 26 may be transmitted even if no vehicle information is received at 82. Additionally, both traffic control information 26 and response information may be transmitted together as described herein. Thus, both response information and information relating to the traffic control sign 20 may be provided to occupant(s) of a vehicle 24 at the same time.

The various embodiments of the communication system 10 may be implemented with any type or kind of traffic control sign 20. As an example, a highway work-zone illustration will be provided. Assume a highway work-zone segmented into three separate sections (sections 1, 2 and 3) each having a traffic control sign 20 configured in accordance with the various embodiments of the invention and having two vehicles (vehicle 1 and vehicle 2) entering the work-zone. Vehicle 1 enters work-zone section 1 at a sign-designated speed of 30 mph (e.g., speed limit posted on traffic control sign 20). When vehicle 1 enters section 2, vehicle 2 enters section 1 at a speed of 45 mph, which is either measured as described herein or transmitted based on in-vehicle computer measurements. Upon determining that the speed of vehicle 2 in section 1 is above a selectable threshold (e.g., posted limited) based on the transmitted vehicle information 27, an "excessive speed" message is transmitted as traffic control information 26 to vehicle 2 from transmitter 58 and received by receiver 38. Assume then that vehicle 2 remains at the excessive speed and that vehicle 1 enters section 3 and must stop abruptly within that section. A determination is then made based on received vehicle information 27 that the speed of vehicle 1 has dropped below a predetermined level and is stopped.

Using a transmitter 58 in section 3 associated with a traffic control sign 20 in that section, a "traffic stopped ahead" message as part of a traffic control information 26 transmission is provided, which may include transmission to a plurality of vehicles 24 and other traffic control signs 20. The receiver 38 of vehicle 2 receives this message and the message is provided to the driver of vehicle 2. For example, a "traffic stopped ahead" message may be displayed on a dash mounted display (e.g., navigation system or separate unit) or audibly provided through speakers. Vehicle 2 then stops behind vehicle 1 in section 3.

As another example, an illustration of an intersection with on-coming traffic alerts for left turning vehicles will be provided. In this illustration, assume a vehicle 24 approaching an intersection emits from the transmitter 34 a transmission message having vehicle information 27, which is then received by the receiver 54 of the traffic control sign 20. The message may include direction-sensitive information (e.g., North, South, East or West) as described herein. Once the message from the vehicle 24 approaching the intersection is successfully received by the traffic control signal 20 (e.g., a stationary traffic signaling device), the transmitter 58 of the traffic control signal 20 then transmits, for example, a "vehicle approaching" message to vehicles 24 approaching the intersection from the remaining two, three, or more directions. Alternatively, other traffic control signals 20 at each of the remaining three roadways 25 (e.g., three signaling devices) and in communication with the first traffic control signal 20 may ten transmit, for example, a "vehicle approaching" message to vehicles 24 approaching the intersection from the remaining directions.

Approaching vehicles having the receiver 38 then receive the transmitted traffic control information 26 and a corresponding message or messages is displayed by the display 48, output by the audio outputting device 47, or tactilely provided (e.g., vibrating seat) by the tactile device 49. The message may include, for example, a first message to "stop" or "proceed with caution" with a second blinking display and appropriate tone/audio providing a "vehicle approaching intersection" message.

Thus, the communication system 10 provides communication of information between traffic control signs and vehicles that improves recognition of traffic control information, thereby reducing the likelihood of adverse consequences (e.g., collisions between vehicles). Further, this information may be communicated to a vehicle, and in particular, provided to the occupant(s) of the vehicle when a traffic control sign is obscured, obstructed or if the driver is unable or inattentive to the traffic control sign.

The methods and systems of the various embodiments provide communication of information between vehicles and traffic control signs. Traffic control information and/or response information is communicated from a traffic control sign to a vehicle via wireless transmission, and vehicle information is communicated from a vehicle to the traffic control sign via wireless transmission. The wireless communication may be performed both when the vehicle is approaching the traffic control sign and after passing the traffic control sign.

The traffic control information from a traffic control sign is communicated to an occupant of the vehicle (e.g. the driver). The occupant may be notified of the traffic control information by visual means, audio means, and/or by tactile means within the vehicle.

The transmission of traffic control information from a traffic control sign to a vehicle may be in response to vehicle information transmitted from the vehicle to the traffic control sign, and may include, for example, warning messages (e.g., warnings of excessive speed, stopped traffic ahead, road condition hazards, road construction ahead, collision imminent, etc.).

While the invention has been described in terms of various specific embodiments, those skilled in the art will recognize that the invention can be practiced with modification within the spirit and scope of the claims.

What is claimed is:

1. A method for communicating between vehicles and traffic control signs, said method comprising:

wirelessly communicating traffic control information from a traffic control sign to a vehicle when the vehicle is approaching the traffic control sign and after the vehicle has passed the traffic control sign, wherein the traffic control sign operates as an antenna; and receiving at the traffic control sign vehicle information communicated from the vehicle.

2. A method in accordance with claim 1, further comprising communicating the traffic control information from the traffic control sign to an occupant of the vehicle including providing the traffic control information at least one of (i) visually, (ii) audibly and (iii) tactilely within the vehicle.

3. A method in accordance with claim 1, wherein the traffic control information from the traffic control sign comprises at least one of speed information, hazard information, warning information and alerting information.

4. A method in accordance with claim 1, wherein the vehicle information comprises at least one of vehicle identification information, vehicle speed, and vehicle direction.

5. A method in accordance with claim 1, wherein the traffic control sign comprises at least one of non-self-illuminating traffic control signs, self-illuminating traffic control signs, traffic control lights, billboards, hazard zone artifacts, flashing road barricades, lane divider cones and barrels.

6. A method in accordance with claim 1, wherein the communicating wirelessly is performed on at least one of a plurality of frequencies within a predetermined frequency range.

7. A method in accordance with claim 1 wherein the traffic control sign includes a housing and the housing operates as an antenna.

8. A method in accordance with claim 1, wherein the communicating wirelessly is performed both when approaching the traffic control sign and after passing the traffic control sign.

9. A method for communicating information to a vehicle, said method comprising:

configuring a traffic control sign to operate as an antenna; and wirelessly transmitting traffic control information from the traffic control sign, wherein the transmitted information is received in a vehicle receiver.

10. A method in accordance with claim 9, further comprising at least one of (i) displaying the traffic control information in the vehicle, (ii) audibly outputting the traffic control information in the vehicle and (iii) tactilely providing the traffic control information in the vehicle.

11. A method in accordance with claim 9, further comprising transmitting vehicle information from at least one vehicle to the traffic control sign.

12. A method in accordance with claim 11, further comprising determining at least one of (i) a speed and (ii) a direction of the at least one vehicle based on the received vehicle information.

13. A method in accordance with claim 11, further comprising configuring at least one antenna for mounting to the vehicle for at least one of transmitting and receiving information from the vehicle.

14. A method in accordance with claim 11, further comprising processing the received vehicle information to determine response information to transmit to the vehicle in response to the received vehicle information.

15. A method in accordance with claim 14, further comprising accessing a set of predetermined responses to determine the response information to transmit to the at least one vehicle.

16. A method in accordance with claim 14, further comprising transmitting the response information to the at least one vehicle.

17. A method in accordance with claim 10, wherein the traffic control sign comprises a laminate structure having a patch antenna integrated therewith.

18. A communication system comprising:

at least one traffic control sign configured as an antenna to wirelessly transmit traffic control information; and at least one vehicle receiver configured to receive the traffic control information transmitted from the at least one traffic control sign.

19. A communication system in accordance with claim 18, wherein the at least one traffic control sign comprises a traffic control sign communication control component having at least one transmitter and the vehicle comprises a vehicle communication control component having the at least one receiver.

20. A communication system in accordance with claim 19, wherein the traffic control sign communication control component is a low power device.

21. A communication system in accordance with claim 18, further comprising at least one antenna in connection with the at least one vehicle receiver, the antenna configured for attachment to one of (i) a grill or (ii) a bumper of the vehicle and wherein the received traffic control information is provided within the vehicle at least one of (i) visually (ii) audibly and (ii) tactilely.

22. A communication system in accordance with claim 18, wherein the vehicle comprises at least one transmitter for transmitting vehicle information and the at least one traffic control sign comprises at least one receiver for receiving the vehicle information.

23. A communication system in accordance with claim 18, wherein die traffic control sign includes a laminate structure having a patch antenna integrated therewith.

24. A communication system in accordance with claim 18, wherein the traffic control sign includes a metal grid defining the antenna.

25. A communication system in accordance with claim 18, wherein the traffic control sign includes metallic ink defining the antenna.

26. A communication system in accordance with claim 18, wherein the traffic control sign transmits information using millimeter wave signals.

27. A communication system in accordance with claim 18, wherein the traffic control sign transmits information at twenty four GHz.

28. A communication system in accordance with claim 18, wherein the traffic control sign transmits information along a narrow beam.

* * * * *